US007044054B2

(12) United States Patent
Stiel

(10) Patent No.: US 7,044,054 B2
(45) Date of Patent: May 16, 2006

(54) PRINTING GROUP OF AN OFFSET ROTARY PRINTING MACHINE

(75) Inventor: Jürgen Alfred Stiel, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 114 days.

(21) Appl. No.: 10/312,597

(22) PCT Filed: Mar. 30, 2001

(86) PCT No.: PCT/DE01/01215

§ 371 (c)(1),
(2), (4) Date: Jan. 22, 2003

(87) PCT Pub. No.: WO02/07976

PCT Pub. Date: Jan. 31, 2002

(65) Prior Publication Data

US 2004/0020383 A1 Feb. 5, 2004

(30) Foreign Application Priority Data

Jul. 22, 2000 (DE) ..... 100 35 785

(51) Int. Cl.
*B41F 5/00* (2006.01)

(52) U.S. Cl. ..... 101/216; 101/177; 101/180; 101/217

(58) Field of Classification Search ..... 101/137, 101/217, 220, 180, 247, 216, 218, 176–178, 101/219, 221, 181, DIG. 35, 215; B41F 7/04, B41F 7/20, 13/00, 13/008
See application file for complete search history.

(56) References Cited

U.S. PATENT DOCUMENTS

| | | | | |
|---|---|---|---|---|
| 4,449,450 | A | 5/1984 | Barny et al. | |
| 4,774,883 | A * | 10/1988 | Mailander | 101/137 |
| 4,887,529 | A * | 12/1989 | Ichikawa et al. | 101/181 |
| 4,960,048 | A * | 10/1990 | Sarda | 101/182 |
| 5,060,569 | A * | 10/1991 | Gladow | 101/216 |
| 5,588,361 | A * | 12/1996 | Riis | 101/216 |
| 5,782,182 | A * | 7/1998 | Ruckmann et al. | 101/177 |
| 6,125,758 | A * | 10/2000 | Sato et al. | 101/479 |
| 6,539,857 | B1 * | 4/2003 | Weschenfelder | 101/137 |

FOREIGN PATENT DOCUMENTS

| | | |
|---|---|---|
| DE | 198 33 468 A1 | 1/2000 |
| DE | 199 19 864 C1 | 5/2000 |
| EP | 0 749 369 B1 | 11/1997 |
| EP | 0 638 419 B1 | 5/1999 |
| EP | 0 958 917 A1 | 11/1999 |
| FR | 2 420 426 | 3/1978 |

* cited by examiner

*Primary Examiner*—Andrew H. Hirshfeld
*Assistant Examiner*—Marissa Ferguson
(74) *Attorney, Agent, or Firm*—Jones Tullar & Cooper PC

(57) ABSTRACT

A printing group of an offset rotary printing machine includes at least one forme cylinder, one transfer cylinder and at least one inking system. Two of these printing groups are arranged opposite to each other. The arrangement of the printing group in relation to each other can be arranged in an axial direction which is parallel to the axes of rotation of the cylinders.

15 Claims, 4 Drawing Sheets

PRINTING GROUP OF AN OFFSET ROTARY PRINTING MACHINE

FIELD OF THE INVENTION

The present invention is directed to a printing group of an offset rotary printing press. Several printing groups are cooperatively arranged and at least one is shiftable in a direction parallel to the axes of rotation of the cylinders.

BACKGROUND OF THE INVENTION

A print unit for a multi-color web-fed rotary printing press for sheet work is known from EP 0 749 369 B1. Two printing groups are arranged in a so-called bridge construction opposite each other in a frame. The arrangement of the printing groups relative to each other can be changed transversely to the direction of the axes of rotation of the cylinders.

An offset printing press is known from DE 198 33 468 A1. This has two oppositely located print units which can be arranged, separated along a vertical plane of separation, and their distance from each other can be changed.

A web-fed rotary printing press is described in EP 0 958 917 A1, and which has several printing units, each consisting of two printing groups. In this case, the printing groups are arranged on top of each other and can be separated along a substantially horizontally extending plane of separation. The individual printing groups can be displaced vertically transversely in respect to the axes of rotation of the cylinders, so that a distance can be provided between the individual printing groups, for example for maintenance work.

A web-fed rotary printing press is known from EP 0 638 419 B1, whose individual components, in particular the cylinder elements and their associated ink and dampening units, are seated in a support frame. In this case, the ink and dampening units are embodied as displaceable units, which can be pulled out of the printing group in an axis-parallel direction of the axes of rotation.

DE 199 19 864 C1 discloses two five-cylinder print units, which can be displaced relative to each other either transversely to or along the axis of rotation of the cylinders.

SUMMARY OF THE INVENTION

The object of the present invention is based on providing a printing unit for an offset rotary printing press.

In accordance with the present invention, this object is attained by providing printing groups that are arranged oppositely to each other. A spacing distance between the opposing groups, in a direction transverse to the axes of rotation of the cylinders can be changed. The arrangement of the printing groups in relation to each other can be changed in a direction approximately parallel to the axes of rotation of the cylinders. The opposing printing groups can be arranged as bridge units in a so-called bridge construction.

The advantages to be gained by the present invention primarily lie in that the required space in front of and behind each of the printing groups, which are respectively arranged in pairs, can be reduced. For performing maintenance work, it is not required to move the printing groups away from each other transversely in relation to the axes of rotation of the cylinder, as taught in the prior art. Instead, the printing groups are arranged to be laterally offset in an axis-parallel direction of the axes of rotation of the cylinders. The printing groups thus become accessible for any required work without the distance between the printing groups transversely to the direction of the axes of rotation of the cylinders needing to be changed. This measure is advantageous, especially in those cases where several printing groups, which are arranged in pairs, are arranged one behind the other, for example in the form of printing towers arranged one behind the other. In this case, it is possible to place the pairs of printing groups, which are arranged one behind the other, at reduced distances from each other. A further advantage ensues from the fact that certain parts of the printing groups, namely the parts which are located the farthest toward the outside on a side of a printing group, are fully accessible with only a relatively small lateral offset between the printing groups. Because of this, it becomes possible, for example, to arrange parts of the printing groups which are particularly maintenance-intensive in this area of the printing groups. For inspection or maintenance of these maintenance-intensive parts of the printing groups, it is not necessary to move them completely apart from each other, but only far enough so that the parts to be maintained are sufficiently accessible.

Not only individual components, consisting of ink and dampening units, can be pulled laterally out of the printing groups of the present invention. Instead, the entire oppositely-located printing groups can be arranged laterally offset. It is thus possible, in particular, to perform maintenance work on substantially all parts of the printing groups without further steps for opening the printing groups becoming substantially necessary.

It is basically sufficient if, for separating the printing groups which are located opposite each other, that these printing groups can be arranged laterally offset in relation to each other in an axis-parallel direction of the axes of rotation of the cylinders. However, it is particularly advantageous if, in addition, the printing groups can be arranged so that their distance in relation to each other, transverse to their axes of rotation, can be at least slightly changed. In the course of moving a printing unit consisting of two oppositely-located printing groups apart, it is then possible, for example, to first displace the one printing group in a direction transversely to the axes of rotation of the cylinders until at least a slight distance between the printing groups has been created. By this movement transversely to the direction of the axes of rotation of the cylinders, it is possible to bring the printing groups initially out of engagement with each other. It is thereafter possible to displace the printing group in an axis-parallel direction to the axes of rotation of the cylinders in order to make the parts located in the interior of the printing group accessible.

Advantageous embodiments ensue from the combination of characteristics of the invention with characteristics already known from the prior art. Characteristics, whose combination into an arrangement of printing groups in accordance with the invention is particularly advantageous, are known from EP 0 749 369 B1 and DE 198 33 468 A1.

BRIEF DESCRIPTION OF THE DRAWINGS

Preferred embodiments of the present invention are represented in the drawings and will be described in greater detail in what follows.

Shown are in.

Figure 1:
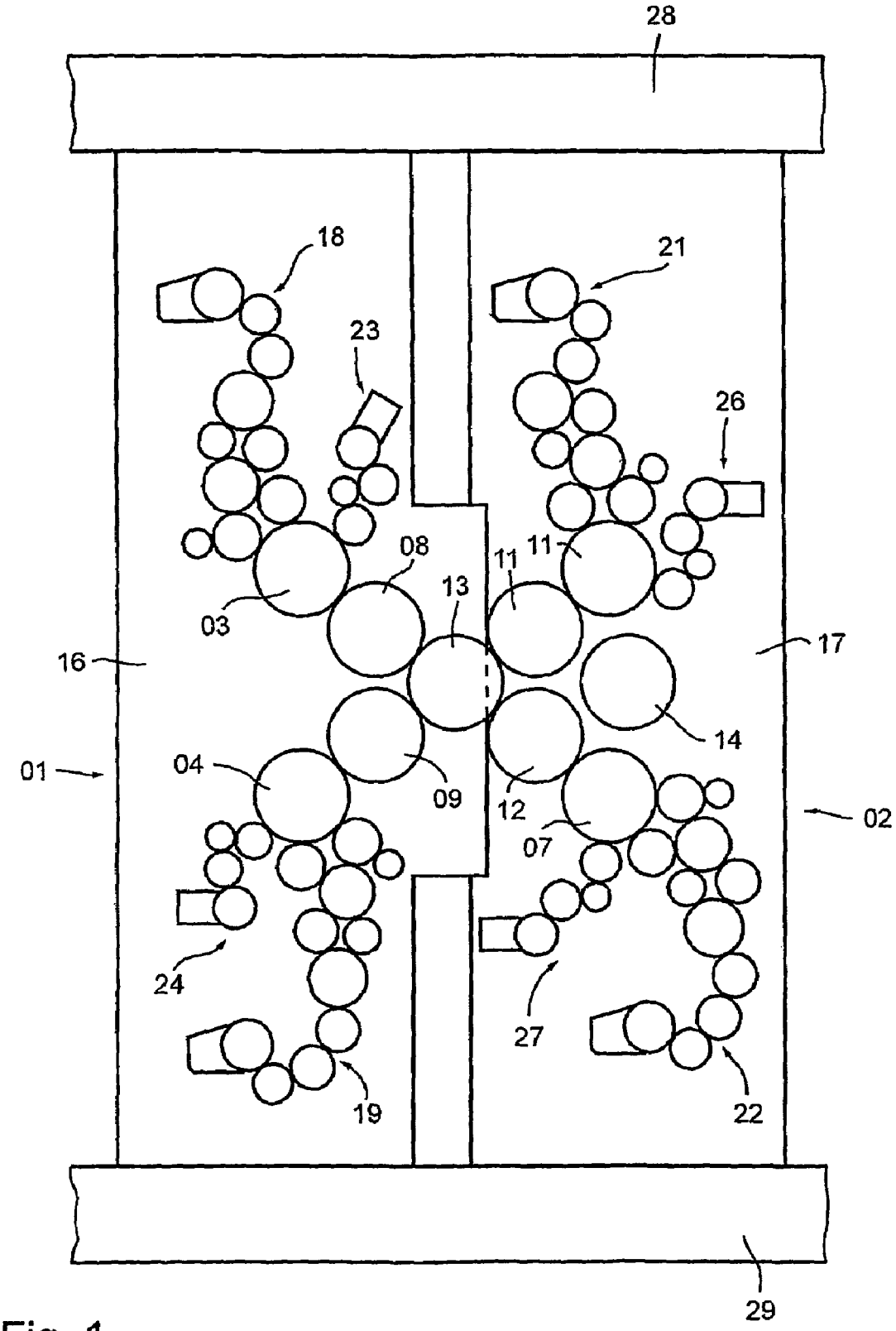
FIG. 1, a side elevation view of a first embodiment of printing groups in accordance with the present invention, FIG. 2, a top plan view of a schematic representation of the arrangement of printing groups in accordance with FIG. 1 in the operational state, FIG. 3, a top plan view of a schematic representation of the arrangement of printing groups in accordance with FIG.
Figure 4:
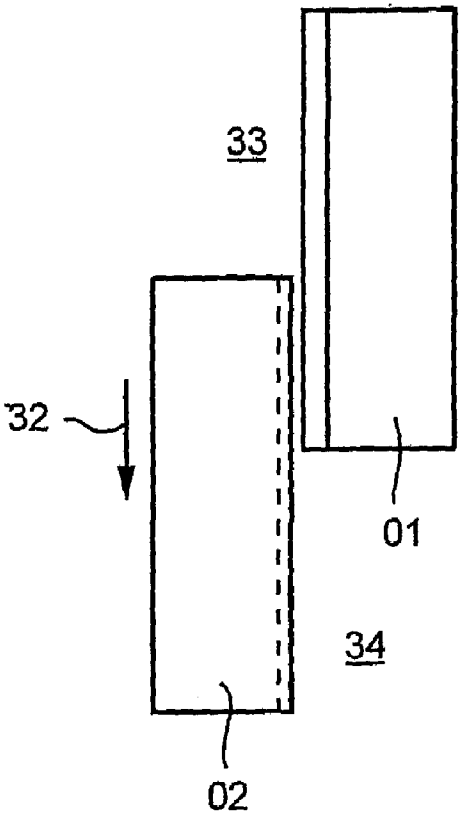
Figure 5:
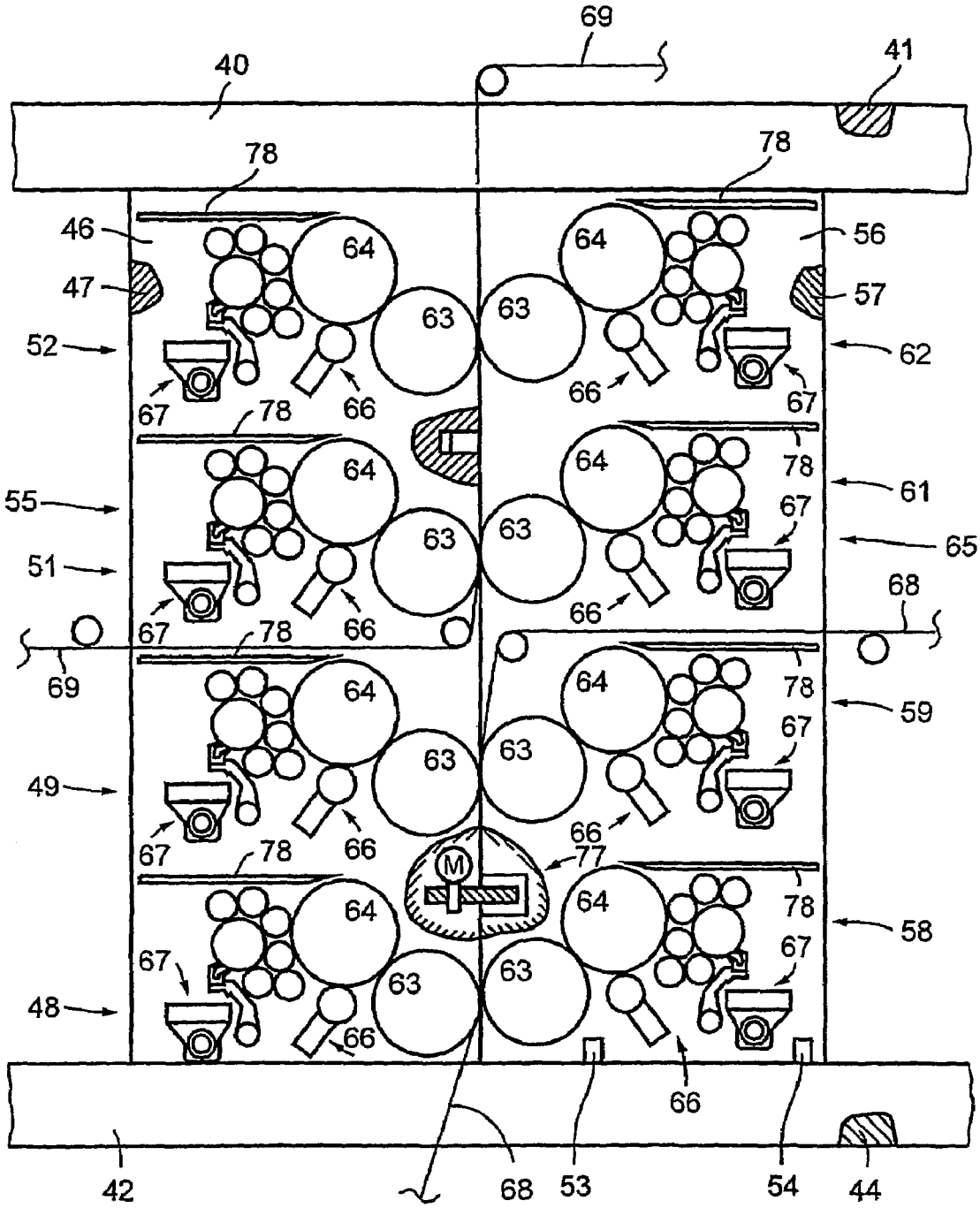
Figure 7:
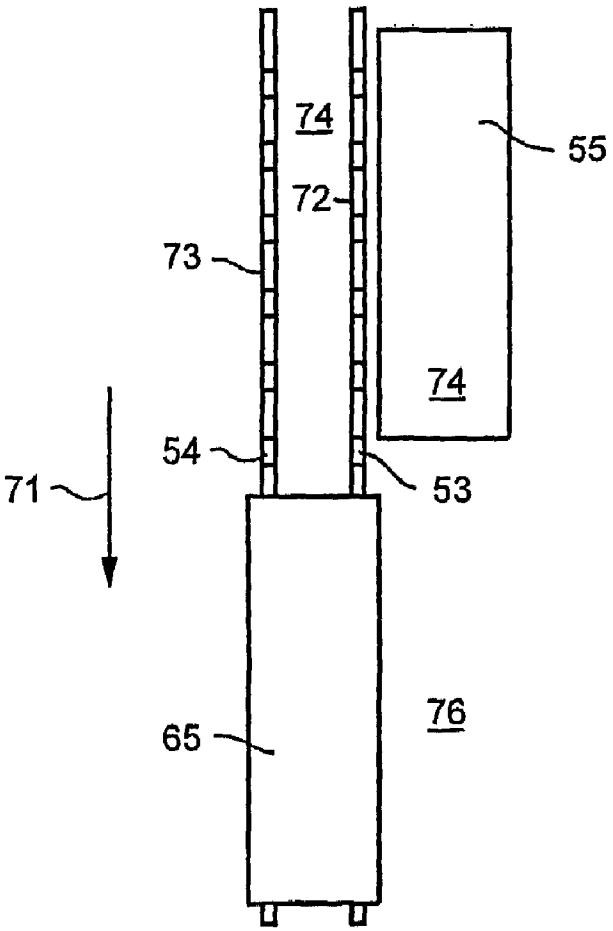
Figure 6:
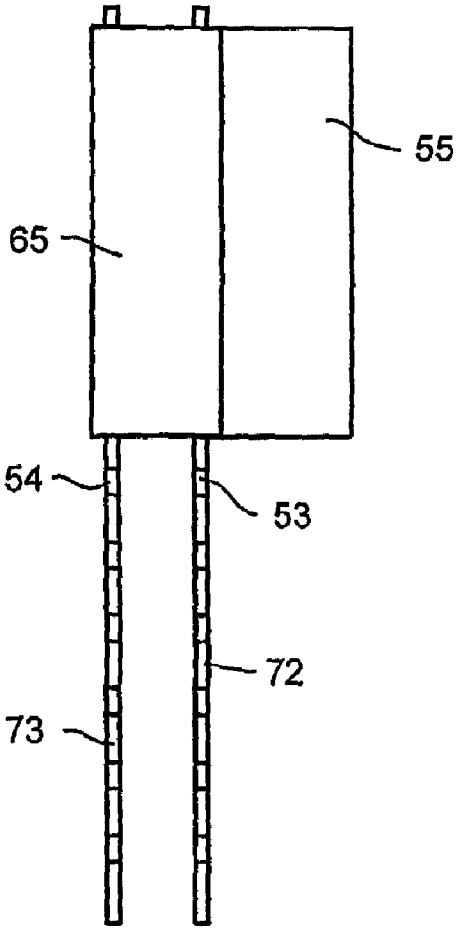

1 when the print groups are separated in a direction transverse to the axes of rotation of the cylinders, FIG. 4, a top plan view of a schematic representation of the arrangement of printing groups in accordance with FIG. 1 when the print groups are opened in a direction parallel to their axes of rotation, FIG. 5, a side elevation view of a second embodiment of printing groups in accordance with the present invention, FIG. 6, a top plan view of a schematic representation of the arrangement of printing groups in accordance with FIG. 5 in the operational state, and in FIG. 7, a top plan view of a schematic representation of the arrangement of printing groups in accordance with FIG. 5 in the opened state.

DESCRIPTION OF THE PREFERRED EMBODIMENTS

An offset rotary printing press, or a section of an offset rotary printing press, has, for example, eight printing groups in a modular construction of printing units, of which only the printing groups 01, 02 which make up one printing unit are represented in FIG. 1. The construction of each of the individual printing groups 01, 02 corresponds, in the essential characteristics of the component of each group, to the construction described in DE 198 33 468 A1.

Each one of these printing groups 01, 02, as seen in FIG. 1, is embodied as a so-called 5-cylinder printing group, and each printing group 01, 02 has substantially two forme cylinders 03, 04, 06, 07, for example plate cylinders, two transfer cylinders 08, 09, 11, 12, for example rubber blanket cylinders, and one counter-pressure cylinder 13, 14, for example a satellite cylinder. The journals of these cylinders 03, 04, 06, 07, 08, 09, 11, 12, 13, 14 are seated in respective lateral frames 16, 17 on each side of the offset rotary printing press. In the first preferred embodiment, the journals of the transfer cylinders 08, 09, 11, 12 are pivotably seated in eccentric bushings or in accordance with three-ring bearing technology, so that the transfer cylinders 08, 09, 11, 12 can be placed against and away from the associated counter-pressure cylinders 13, 14. It is also possible to place the counter-pressure cylinders 13, 14 against the associated transfer cylinders 08, 09, 11, 12, for example by use of eccentric bushings, three-ring bearings or by linear guidance.

In the first preferred embodiment, each cylinder 03, 04, 06, 07, 08, 09, 11, 12, 13, 14 is provided with its own, rpm-controlled and/or position-controlled drive motor. However, it is also possible to assign a drive motor to each pair of forme and transfer cylinders 03, 08; 04, 09; 06, 11; and 07, 12, and to positively couple each pair. In this case, each counter-pressure cylinder 13, 14 also has its own drive motor, or it can be coupled to one of the pairs of forme or transfer cylinders 03, 08; 04, 09; 06, 11; or 07, 12. It is also possible to assign only one drive motor to each printing group 01, 02 and to transmit the drive moment to be transferred by means of a vertical shaft, for example. Independently of the type of drive mechanism it is possible to arrange a coupling between one or several cylinders and each of the associated drive mechanisms, so that each individual cylinder or cylinder group can be separately switched in. In any case, the drive motors for each printing group are fixedly assigned to each lateral frame 16, 17, associated with that printing group, independently of the position and installation location of the printing groups 01, 02, so that in the printing group 02, which is placed pivoted by 180° around a vertical line, the drive motors are arranged on the opposite side of the printing press when compared with the drive motors associated with the printing group 01. One ink unit 18, 19, 21, 22, and one dampening unit 23, 24, 26, 27 is assigned to each one of the forme cylinders 03, 04, 06, 07. In the first preferred embodiment represented in FIG. 1, the printing group 01 is embodied as a V-printing group 01, for example, and the printing group 02 as a W-printing group 02, for example. The printing groups 01, 02 can each be operated independently of each other as five-cylinder printing groups located opposite each other, so that in a first mode of operation, which is not specifically depicted, two oppositely located printing groups 01, 02 functionally constitute a ten-cylinder satellite printing group. During this first operating state, the transfer cylinders 08, 09, and 11, 12 interact with the counter-pressure cylinder 13 of the V-printing group 01 and with the counter-pressure cylinder 14 of the W-printing group 02, respectively. In a second operating state, two five-cylinder printing groups functionally act as a nine-cylinder satellite printing group. This second operating state is represented in FIG. 1. For this purpose, the transfer cylinders 08, 09, 11, 12 of the V-printing group 01 and of the W-printing group 02 can be placed against and away from the counter-pressure cylinder 13 of the V-printing group 01. In this second operating state, the counter-pressure cylinder 14 of the W-printing group 02 is not part of the printing process.

The printing groups 01, 02 are fastened in a support element, of which only the upper and lower transverse supports 28, 29, respectively have been schematically represented in FIG. 1. In this case, the V-printing group 01 is connected, fixed in place, with the transverse supports 28, 29, while the W-printing group 02 is displaceably seated in the support element. The printing unit or section of the offset rotary printing press formed from the printing group 01, 02 can be opened by the press operators, in particular for servicing and maintenance. The required actuating movements for opening the printing unit or section formed from the printing group 01, 02 are schematically depicted in FIGS. 2 to 4.

Figure 3:
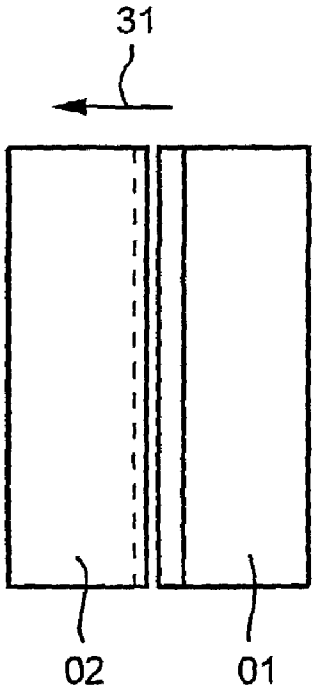
Figure 2:
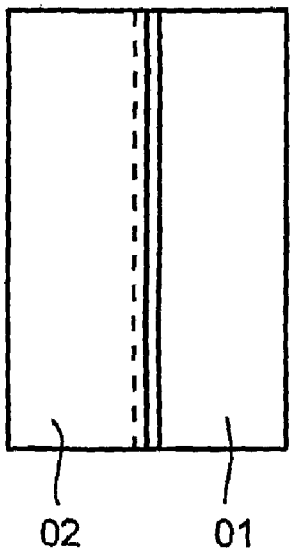

In FIGS. 2 to 4, the printing groups 01, 02 have only been schematically represented, with the surrounding support elements left out. In FIG. 2, the printing groups 01, 02 are represented in a top plan view in the operating state shown corresponding to the operating state in FIG. 1. The movably seated printing group 02 is locked together with the fixedly seated printing group 01, so that the printing groups 01, 02 together constitute a fixed-in-place printing unit or section of the offset rotary printing press. For opening the printing unit or section, the printing groups 01, 02 are first transversely separated, as represented in FIG. 3, in that the printing group 02 is displaced during an actuating movement indicated by the movement arrow 28 in a direction transversely to the axes of rotation of the cylinders 03, 04, 06, 07, 08, 09, 11, 12, 13, 14. A transverse separation distance between the printing groups 01, 02 is created by this, so that the printing groups 01, 02 are no longer in engagement with each other. Subsequently, the printing group 02 is displaced axially or laterally toward the side during an actuating movement, as indicated by the movement arrow 32 in a direction axis-parallel with the axes of rotation of the cylinders 03, 04, 06, 07, 08, 09, 11, 12, 13, 14, as represented in FIG. 04, so that, depending on the lateral offset between the printing groups 01, 02, increasingly larger areas of the interior of the printing groups 01, 02 become accessible for servicing and maintenance work. In the process, the printing group 02 can be displaced outward, i.e. in the preferred embodiment represented toward the side, to such an extent, that the printing groups 01, 02 are no longer located opposite each other, so that all areas of the interior of the printing groups 01, 02 are accessible from work platforms arranged in the areas 33, 34. For closing the printing unit or section of the offset rotary printing press that is constituted by the printing groups 01, 02, the printing group 02 is displaced in a reversed sequence and is finally locked to the printing group 01.

FIG. 5 shows a second preferred embodiment of an arrangement of printing groups 48, 49, 51, 52,58, 59, 61, 62 in accordance with the present invention. The upper supports 40, 41, as well as the lower supports 42, 44 of a multi-color web-fed rotary printing press receive these several printing groups 48, 49, 51, 52,58, 59, 61, 62, which are fixed on the supports and which are arranged on top of each other, in a left frame element 55 and in a right frame element 65 formed on the lateral frames 46, 47. The printing groups 48, 49, 51, 52 seated in the left frame element 55 are seated fixed in place and will be called the left, fixed printing group 48, 49, 51, 52 in what follows. Furthermore, a right frame element 65, which is displaceable on rollers 53, 54 and is formed by the right lateral frames 56, 57, is arranged between the upper supports 40, 41, and the lower supports 42, 44. The right, movable printing groups 58, 59, 61, 62 are arranged opposite the left, fixed printing groups 48, 49, 51, 52 in the movable lateral frames 56, 57 of the right frame element 65.

In their essential printing characteristics, the construction of the individual printing groups 48, 49, 51, 52 and 58, 59, 61, 62, and of the printing units or sections formed thereof corresponds to the construction described in EP 0 749 369 B1. Each printing group 48, 49, 51, 52 and 58, 59, 61, 62 respectively consists of a transfer cylinder 63, for example a rubber blanket cylinder, which interacts with a forme cylinder 64, for example a plate cylinder. The forme cylinder 64 is provided with a dampening agent by a dampening unit 66 and with ink by an ink unit 67. The ink unit 67 can, for example, consist of an ink trough with an ink roller, wherein the ink roller transfers its printing ink to the forme cylinder 64 by operation of intermediate ink application rollers. In place of two ink application rollers, it is also possible to use only one smaller or larger ink application roller. It is also possible, for example, to use a chamber doctor blade in connection with a screen roller, or anilox roller, for example, in place of an ink trough, as well as an ink application roller. However, a conventional ink unit can also be employed.

Each dampening unit 66 can be embodied as a spray dampening unit consisting of a known spray device, for example a strip with spray nozzles, whose sprays are directed on a dampening agent application roller. This dampening agent application roller is connected with the forme cylinder 64.

The printing groups 48, 49, 51, 52, fixedly arranged on the left lateral frames 46, 47 of the left frame element 56 between the supports 40, 41; 42, 44 as well as the printing groups 58, 59, 61, 62, arranged on top of each other between the supports 40 41; 42, 44 in the displaceable right frame element 65, are each arranged with their transfer cylinders 63 facing each other, so that a web 68 or 69 can be imprinted on both sides. As a result, the printing group 48 together with group 58, the printing group 49 together with group 59, the printing group 51 together with group 61, and the printing group 52 together with group 62 each comprise a bridge printing unit, or a print unit in bridge construction.

In this case, the right printing groups 58, 59, 61, 62 are arranged in the displaceable right frame element 65 in such a way that they can be displaced relative to the left printing groups 48, 49, 51, 52 horizontally in an axis-parallel direction of the axes of rotation of the cylinders 63, 64. To make this function clear, the left and the right frame elements 55, 65 are represented in FIGS. 6 and 7 in a top plan view. The representations in FIGS. 6 and 7 are purely schematic, with all details not required for understanding the function having been left off. The left and the right frame elements 55, 65 are represented in the operating state in FIG. 6, in which they are locked together. Following unlocking, the right frame element 65 can be laterally displaced in an axis-parallel direction in respect to the axes of rotation of the cylinders 63, 64, as indicated by the lateral movement arrow 71. Rails 72, 73 are provided for this purpose between the supports 40, 41, 42, 44, on which rollers 53, 54 are seated.

In addition, the right printing groups 58, 59, 61, 62, which are supported by the right frame element, can be displaced relative to the printing groups 48, 49, 51, 52 in the direction of the axes of rotation of the cylinders 63, 64.

As represented in FIG. 7, the right frame element 65 can be displaced laterally to the side, i.e. in the embodiment represented toward the right, until the right and left printing groups 48, 49, 51, 52 and 58, 59, 61, 62, respectively are completely separated from each other, and therefore are easily accessible to the press operators for service or maintenance work from the work platforms arranged in the areas 74 or 76. For example, the displaceable right frame element 65 can be actuated by the use of two reciprocally acting work cylinders, for example hydraulic cylinders. However, other types of driving are of course also conceivable, for example by electric motors. For example, guide strips known from EP 0 749 369 B1, can be used for guiding the right frame element 65. For achieving a high degree of exact fit in the operating position of the displaceable right frame element 65, it is possible to provide several pins, which can extend past the closing edge, on the frame element 65, and which can be brought into engagement with correspondingly arranged blind bores on the fixed-in-place left frame element 55.

In the operating position depicted in FIG. 5, the displaceable frame element 65 is secured against inadvertent displacement by a mechanically operating locking element 77. The locking element 77 consists of a threaded bushing, seated fixed in place on the frame element 65, which, in the course of closing, forms a positive connection with a threaded spindle, seated fixed in place on the frame element 55. In the course of this locking connection, the threaded spindle is moved in the direction of the left frame 55 by a motor-driven threaded bushing.

During a stoppage of the printing press, it is possible for the operators to manually change the printing plates on the forme cylinders 64 of the left and right printing groups 48, 49, 51, 52 or 58, 59, 61, 62. For this purpose the frame elements 55, 65 must be moved far enough apart, so that the appropriate forme cylinders 64 are sufficiently accessible. Alternatively, it is also possible to change the printing plates on the forme cylinders 64 by use of a printing plate changing device 78, which is assigned to each printing group 48, 49, 51, 52 or 58, 59, 61, 62. For example, the printing plate changing device 78 can be embodied in the same way as the printing plate changing device described in EP 0 749 369 B1.

The driving of the individual printing groups 48, 49, 51, 52 or 58, 59, 61, 62 can be provided by use of a vertical shaft, or by use of individual drive motors assigned to the individual cylinders. A suitable drive concept is described in EP 0 749 369 B1, for example.

While preferred embodiments of a printing group in accordance with the present invention have been set forth fully and completely hereinabove, it will be apparent to one of skill in the art that various changes in for example the overall size of the printing press, the specific type of web being printed, and the like could be made without departing from the true spirit and scope of the present invention which is accordingly to be limited only by the appended claims.

What is claimed is:

1. A printing unit of an offset rotary printing press comprising:

a first printing group in the printing unit and having a plurality of first printing group components including at least a first frame cylinder, a first transfer cylinder and a first ink unit, said first printing group components having first printing group component axes of rotation extending in a first direction;

a first printing group frame supporting said first printing group in the printing unit;

a second printing group in the printing unit and having a plurality of second printing group components including at least a second forme cylinder, a second transfer cylinder and a second ink unit, said second printing group components having second printing group component axes of rotation extending in a second direction parallel to said first direction;

a second printing group frame supporting said second printing group in the printing unit;

means supporting at least said first printing group, in said first printing group frame, and said second printing group, in said second printing group frame, for cooperation with each other to act with each other as at least a first printing group pair, said at least a first printing group pair being part of the printing unit which is configured as a bridge printing unit in bridge construction, said first and second transfer cylinders of said first and second printing groups being oriented toward each other and cooperating to print a web passing between said first and second transfer cylinders while said first and second printing groups are cooperating with each other to form said bridge printing unit; and a support element supporting said at least first printing group frame and said second printing group frame of said bridge unit in the printing unit for movement of at least one of said first printing group frame and said second printing group frame in the printing unit with respect to the other one of said at least first printing group frame and said second printing group frame in said bridge unit in the printing unit formed by the cooperation of said first printing group and said second printing group in a direction parallel to said first and second printing group axes of rotation of said cylinders to separate said first and said second printing groups, which cooperate to form the printing unit, laterally with respect to each other in said direction parallel to said first and second printing group axes of rotation to separate said printing groups of the printing unit apart from each other to provide access to said components of both of said first and second printing groups in response to said lateral movement of said one of said first printing group frame and said second printing group frame in the printing unit.

2. The printing unit of claim 1 further wherein said at least first and second printing groups are supported so that a distance between said first and second printing groups in a direction transverse to said first and second printing group axes of rotation can be changed.

3. The printing unit of claim 1 wherein one of said first and second printing groups is fixed.

4. The printing unit of claim 1 wherein said first and second printing group frames can be locked together in a operational state of the printing press.

5. The printing unit of claim 1 further including at least a second printing group pair, said second printing group pair being arranged on top of said first printing group pair.

6. The printing unit of claim 1 wherein said support element includes transverse supports and vertical supports.

7. The printing unit of claim 1 wherein said first and second printing group frames are separable horizontally.

8. The printing unit of claim 7 wherein one of said first and second printing group frames is fixed and the other of said first and second printing group frames is displaceable relative to said one.

9. The printing unit of claim 8 further including rollers supporting said displaceable one of said first and second printing group frames.

10. The printing unit of claim 1 further including a third forme cylinder, a third transfer cylinder and a first counter-pressure cylinder in said first printing group and a fourth forme cylinder, a fourth transfer cylinder and a second counter-pressure cylinder in said second printing group.

11. The printing unit of claim 10 wherein said first printing group and said second printing group are a v-printing group and a w-printing group.

12. The printing unit of claim 11 wherein said v-printing unit is fixed.

13. The printing unit of claim 10 wherein said first printing group and said second printing group can be coupled together.

14. The printing unit of claim 13 wherein said first and second printing groups are adapted to print at least one web.

15. The printing unit of claim 10 wherein said first, second, third, and fourth transfer cylinders are engageable with one of said first and second counter-pressure cylinders.

* * * * *